United States Patent [19]

Ridings

[11] Patent Number: 4,621,753

[45] Date of Patent: Nov. 11, 1986

[54] BELT SUPPORTED TOOL CARRIER

[75] Inventor: Jody W. Ridings, Shelby, N.C.

[73] Assignee: Plastic Oddities, Inc., Shelby, N.C.

[21] Appl. No.: 700,719

[22] Filed: Feb. 11, 1985

[51] Int. Cl.[4] ..... A45F 5/00

[52] U.S. Cl. ..... 224/253; 224/234; 224/904

[58] Field of Search ..... 224/192, 251, 904, 253, 224/224, 191, 234; D2/400

[56] References Cited

U.S. PATENT DOCUMENTS 2,835,944 5/1958 Johnston ..... 224/904
3,450,317 6/1969 Ramer .
4,372,468 2/1983 Harvey .
4,457,462 7/1984 Taormina .
4,544,089 10/1985 Tabler ..... 224/192

*Primary Examiner*—Stephen Marcus
*Assistant Examiner*—David Voorhees
*Attorney, Agent, or Firm*—Laurence R. Brown

[57] ABSTRACT

A belt supported tool carrier is formed from a single plastic strip bent into a cylinder by overlapping ends having belt receiving slits therein. Two or more slits in each of the overlapping ends of the plastic strip permit different size cylindrical diameters to be formed from a single strip, thus accommodating different tool shaft sizes.

3 Claims, 5 Drawing Figures

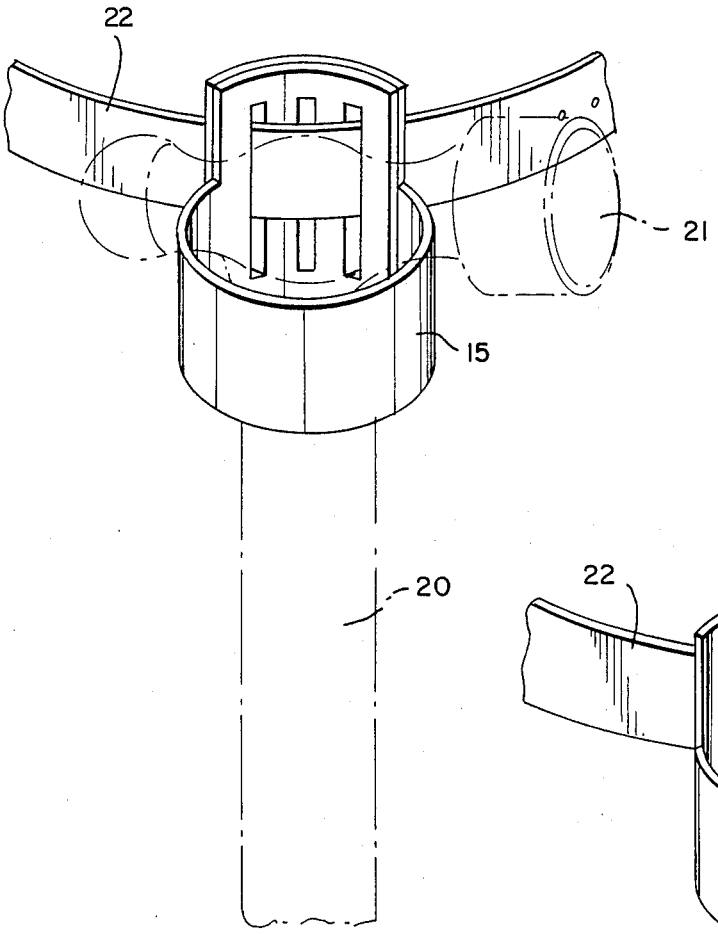
FIG. 3
FIG. 4
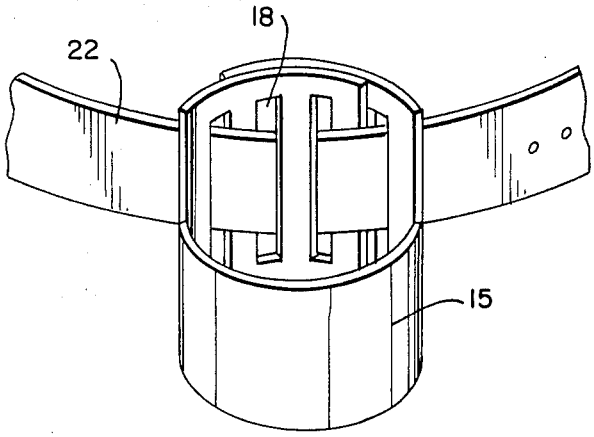
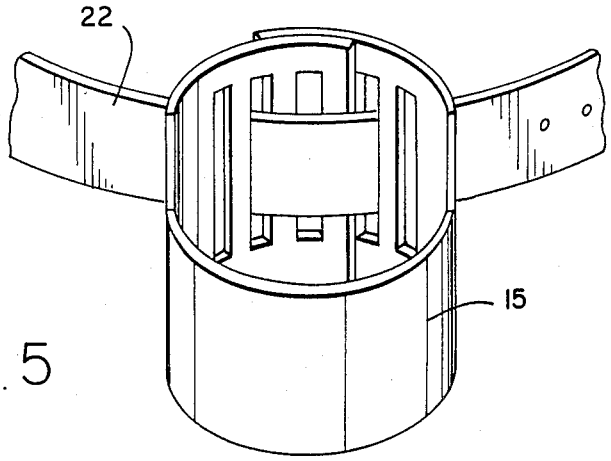
FIG. 5

BELT SUPPORTED TOOL CARRIER

TECHNICAL FIELD

This invention relates to tool holders and more particularly it relates to belt supported belt holders.

BACKGROUND ART

Examples of prior art belt supported tool holders are found in U.S. Pat. Nos. 3,450,317 to P. C. Ramer dated June 17, 1969; 4,372,468 to R. P. Harvey granted Feb. 8, 1983; and 4,457,462 to U. C. Taormina granted Jul. 3, 1984. Such tool holders are expensive and complex because of the necessity to shape metal structures, and the necessity to assemble and attach a plurality of parts. Furthermore, they are fixed in size and different sized tools require different sized holders.

It is a general object of this invention to improve the state of the art.

As is well known, hammers, hatchets, flashlights, trowels, screw drivers and similar headed tools, are widely used in construction and handiwork. There is a need in these fields for a tool holder which may be easily and removably attached to the belt of the worker which also may be adjusted to hold a wide range of tools of varying sizes and shapes.

As is further known to those in the field of tool holder manufacturing it is necessary to provide a tool holder which is inexpensive to manufacture and ship, easy to use and which is durable.

Previous tool holders have been expensive to manufacture, and made with several parts such as leather and metal and rivets which provide zones for breakage after extended use. Other tool holders have been made of only metal making them uncomfortable for the user and heavy in weight and bulky in storage.

Therefor, it is the object of this invention to provide a tool holder which is inexpensively and easily manufactured.

It is another object of this invention to provide a tool holder which is adjustable to varying sizes of tools.

It is still another object of this invention to provide a tool holder which is easily assembled and disassembled from a worker's belt, and when disassembled the tool holder stores neatly in a flat position.

DISCLOSURE OF THE INVENTION

This invention provides a belt supported tool carrier formed of a single strip of plastic or fabric which may be formed into a tool holding cylinder with a plurality of belt mounting slits therein at each end of the plastic strip permitting the strip to be held in cylindrical form with the belt through the slits and permitting the diameter of the cylinder to be varied for tools of different size by mating different ones of the slits with the belt. Thus a set of two or more apertures are placed in each end of a flat strip of enough stability to permit the strip to be formed into a cylinder for holding a tool shaft with the ends of the strip overlapped to mate the positions of the apertures for receiving a belt through at least one aperture in each end. Thus, the entire tool holder for use on a one inch (2.54 cm) wide belt for holding a tool shaft such as a hammer handle of between one and two inches (2.54 to 5 cm) in diameter is simply a flat strip of plastic such as polypropylene of a thickness of about 0.12 in. (0.3 cm) and a length of about 6 in. (15 cm). The strip has two end tabs extending inwardly about 2 in. (5 cm) from each end and about 1.5 inch. (4 cm) wide extending from a central strip section about one inch (2.54 cm) wide. Preferably three 1.2 inch (3 cm) long and 0.3 in. (0.8 cm) wide slits are spaced about 0.8 in. (2 cm) apart in each end tab. This strip when bent into cylindrical shape and fastened to a belt passing through the slits gives a range of three different size diameters for use with tools of different sizes. Of course, the strip dimensions may be varied to accommodate smaller or larger tools. The wider end tab construction also serves the function of holding a hammer head, for example, substantially parallel to the tangent position on the belt of the user, when the cylinder is formed by the strip and located on the belt.

The tool holder of this invention thereby comprises a cylindrical tool shaft holder formed from a strip of material having belt engaging slits at each end thereof.

BRIEF DESCRIPTION OF THE DRAWINGS

Throughout the drawings like reference characters identify similar features to facilitate comparison.

In the drawing

FIG. 3 is a perspective view of a tool holder positioned on a belt, with a hammer carried therein shown in phantom view; and FIGS. 4 and 5 are further perspective views of the same belt supported tool carrier strip of FIG. 3 mounted on a belt to provide cylinders of differing diameters for fitting tools with different shaft sizes.

THE PREFERRED EMBODIMENT

Figure 1:
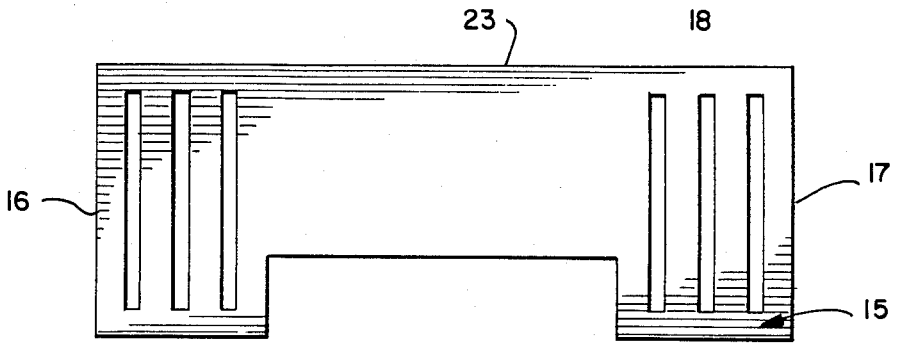
FIG. 1 is a plan view of a strip of material forming the tool carrier embodying this invention.
Figure 2:
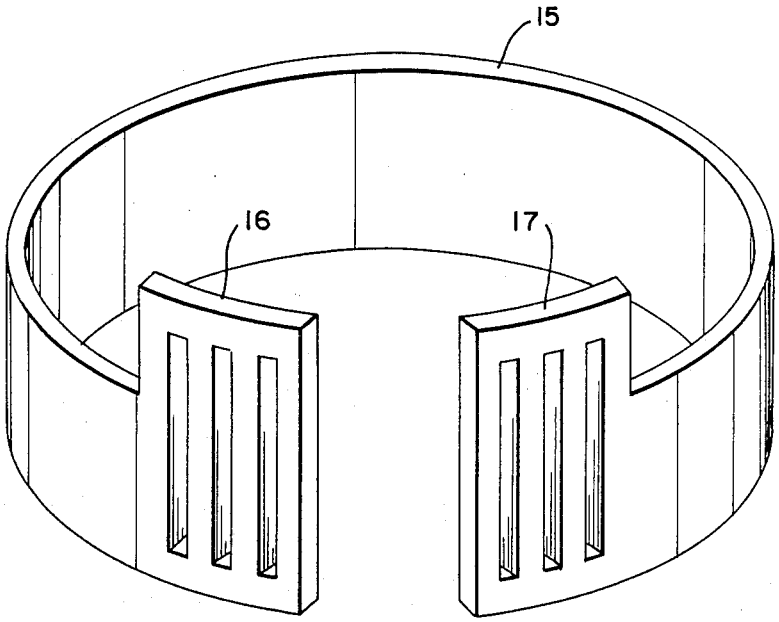
FIG. 2 is a perspective view of a cylinder formed by the strip of FIG. 1.

In FIGS. 1 and 2 of the drawing, it is seen that the flat plastic strip 15 has the properties that it will either lay flat or can be shaped into a substantially cylindrical body. The two opposing end portions 16, 17 have defined in each end thereof a plurality, preferably three of the belt receiving slits 18. The end portions 16 and 17 may thus be overlapped as shown in FIGS. 3 to 5 to form cylinders having vertical axes of a plurality of different diameters for receiving different sized shafts 20 of tools such as hammer 21 therein, as held in place by threading belt 22 through various combinations of the slits 18. It is seen that the width of end portions 16 and 17 of strip 15 is greater than that of connecting portion 23, to dispose hammer head 21 in a position parallel to the tangent of the belt when carried in the holder cylinder. The strip 15 dimensions, of course, can vary to hold the shaft or handle 20 away from the body if desired, and to have different size diameter and length cylindrical bodies formed by the strip 15.

It is seen that the strips 15 may be readily stored in small space, have very little cost, and are adaptable to different tool sizes. Nor are there any metal parts necessary, requiring manufacturing steps or forming joints which can weaken the tool holder in use.

Therefore this invention has advanced the state of the art, and those novel features believed to describe the spirit and nature of the invention are defined with particularity in the following claims.

I claim:

1. A tool carrier for support on the belt of a person for holding a tool shaft therein, consisting of a single strap formed into a substantially open bottomed cylindrical body and of a length permitting the ends thereof to overlap when forming said cylindrical body of a predetermined size for receiving the shaft of a tool, wherein at least two slits extending through each of the strap ends, including at least one overlapping end portion, are disposed for receiving a belt threaded therethrough to position the tool carrier on the belt with the cylindrical body axis vertical.

2. The tool carrier of claim 1 wherein the strap is made of a thickness of a plastic material that will tend to lay flat unless formed into a cylindrical shape and be held in that configuration by a belt threaded through the slits.

3. A tool carrier for support on the belt of a person for holding a tool shaft therein, consisting of a single strap formed into a substantially open bottomed cylindrical body and of a length permitting the ends thereof to overlap when forming said cylindrical body of a predetermined size for receiving the shaft of a tool, the strap end portions having vertical slits therein being of greater height than the intermediate portion of said strap between said end portions so that it defines a constrictive surface for the handle and a bearing surface for the tool head to bear against.

* * * * *